US007107642B2

(12) United States Patent
Wong et al.

(10) Patent No.: US 7,107,642 B2
(45) Date of Patent: Sep. 19, 2006

(54) ADJUSTABLE MATTRESS AND PILLOW SYSTEM

(75) Inventors: Sui-Kay Wong, North Point (CN); Tit Shing Wong, Hong Kong (CN); Wa Choi Cheung, Shatin (CN); Him Fung Hau, Tuen Mun (CN)

(73) Assignee: JETTA Company Limited, Hong Kong (CN)

( * ) Notice: Subject to any disclaimer, the term of this patent is extended or adjusted under 35 U.S.C. 154(b) by 46 days.

(21) Appl. No.: 10/796,463

(22) Filed: Mar. 9, 2004

(65) Prior Publication Data

US 2004/0177449 A1 Sep. 16, 2004

Related U.S. Application Data

(60) Provisional application No. 60/454,000, filed on Mar. 12, 2003.

(51) Int. Cl.
*A47C 27/10* (2006.01)
*G05D 7/00* (2006.01)

(52) U.S. Cl. ..... 5/713; 700/282

(58) Field of Classification Search ..... 5/713, 5/710, 715, 731, 733, 734; 700/282
See application file for complete search history.

(56) References Cited

U.S. PATENT DOCUMENTS 1,282,980 A * 10/1918 Takach ..... 5/706
4,542,547 A * 9/1985 Sato ..... 5/713
4,805,633 A * 2/1989 Kotani et al. ..... 600/528
5,170,364 A * 12/1992 Gross et al. ..... 702/139
5,560,374 A * 10/1996 Viard ..... 5/713
5,577,399 A * 11/1996 Whipple et al. ..... 68/12.02
5,630,238 A * 5/1997 Weismiller et al. ..... 5/600
5,787,531 A * 8/1998 Pepe ..... 5/710
5,794,289 A * 8/1998 Wortman et al. ..... 5/713
5,963,997 A * 10/1999 Hagopian ..... 5/654
5,966,763 A * 10/1999 Thomas et al. ..... 5/715
6,047,424 A * 4/2000 Osborne et al. ..... 5/713
6,108,843 A * 8/2000 Suzuki et al. ..... 5/713
6,119,291 A * 9/2000 Osborne et al. ..... 5/600
6,154,907 A * 12/2000 Cinquin ..... 5/713
6,353,950 B1 * 3/2002 Bartlett et al. ..... 5/617
6,421,858 B1 * 7/2002 Cuerel ..... 5/713
6,668,408 B1 * 12/2003 Ferrand et al. ..... 5/710
6,721,980 B1 * 4/2004 Price et al. ..... 5/713
2002/0039008 A1 * 4/2002 Edgar et al. ..... 318/445
2002/0070866 A1 * 6/2002 Newham ..... 340/573.1

(Continued)

FOREIGN PATENT DOCUMENTS

EP 0489310 6/1992
WO WO 0024353 5/2000

*Primary Examiner*—Thomas B. Will
*Assistant Examiner*—Gay Ann Spahn
(74) *Attorney, Agent, or Firm*—R. Neit Sudol; Henry D. Coleman; William J. Sapone

(57) ABSTRACT

The invention provides a novel adjustable mattress and pillow system and related methods in which a sensing mat positioned on the top face of a mattress affects microprocessor-controlled optimization of the contour of the mattress and a pillow based on a user's position. In one embodiment, the novel adjustable mattress and pillow system of the invention provides real time contour optimization through use of a variety of sensing techniques that make the system particularly useful in environments such as hospital critical care facilities where proper positioning of a user on a mattress and a pillow may prove important to user's health.

44 Claims, 2 Drawing Sheets

U.S. PATENT DOCUMENTS

2002/0178503 A1* 12/2002 Reeder et al. ..... 5/690
2002/0178504 A1* 12/2002 Yung ..... 5/713
2003/0014819 A1* 1/2003 Richardson ..... 5/644
2003/0182728 A1* 10/2003 Chapman et al. ..... 5/713
2003/0208848 A1* 11/2003 Flick et al. ..... 5/713
2003/0221261 A1* 12/2003 Torbet et al. ..... 5/713
2004/0083550 A1* 5/2004 Graebe, Jr. ..... 5/654

* cited by examiner

ADJUSTABLE MATTRESS AND PILLOW SYSTEM

RELATED APPLICATIONS

The instant invention claims priority from U.S. Provisional Patent Application Ser. No. 60/454,000 filed Mar. 12, 2003.

FIELD OF THE INVENTION

The invention provides a novel adjustable mattress and pillow system and related methods in which a sensing mat positioned on the top face of a mattress affects microprocessor-controlled optimization of the contour of the mattress and a pillow by pre-selected inflation or deflation of pillow and mattress compartment or compartments based on a user's position. In one embodiment, the novel adjustable mattress and pillow system of the invention provides real time contour optimization through use of a variety of sensing techniques that make the system particularly useful in daily home-use and in environments such as hospital critical care facilities where proper positioning of a user on a mattress and a pillow may prove important to user's health.

BACKGROUND OF THE INVENTION

Due to the contact shapes of a head and body in contact with pillow and mattress changes with sleeping pose, it is difficult to have a pillow/mattress fit and provide a comfortable support during various sleeping poses, even for a normal healthy person.

It is even worse for a person suffering from chronic back or neck pain; he or she is often is unable to sleep comfortably, and may not be able to recline on a traditional mattress and pillow without great discomfort. Even if a person suffering from such ailments is able to fall asleep, unavoidable movement during sleep can exacerbate an underlying ailment and wake the individual. Similarly, a patient suffering from trauma such as a burn, or recovering from surgery, may suffer great discomfort caused by shifting body and head position on a traditional mattress and pillow. Improper body positioning can cause serious risk to an injured or post-surgical patient, for example, by exacerbating a wound through undesirable rubbing against a mattress or pillow surface or by otherwise creating conditions that may give rise to infection. In neonatal and other critical care settings, improper patient positioning on a mattress can prove life-threatening.

U.S. Pat. No. 6,385,803 ("'803 Patent") discloses one of many methods or systems that attempt to provide improved means to support a body. The '803 Patent discloses a method and apparatus for supporting the body of a patient. The apparatus disclosed is a support device essentially comprising only at least one closed or controlled-release chamber together with inlet and outlet means by which a filling fluid can be fed in or removed, and an independent control device which is disposed under the support device. The control device comprises filling and emptying means for filling the chamber with filling fluid or for emptying said fluid there from and control means for controlling feeding in and removing the filling fluid. This apparatus and system is understood to measure body penetration into a support chamber and adjust such penetration independent of a user's body position. The system and apparatus of the '803 Patent are understood to use servo control techniques to control the user's body penetration.

U.S. Pat. No. 6,421,858 ("'858 Patent") discloses a mattress having at least one cushion element which is adapted to be inflated with a pumpable filling medium and a device for regulating the pressure of said filling medium in said cushion element, said device being equipped with a control in which at least one of filling pressure values and at least one arithmetical operation for determining a filling pressure value are predetermined or programmed.

Despite available apparatus and systems, the need continues to exist for a mattress and pillow system and related apparatus that will facilitate real-time optimization of the contour of the mattress and a pillow based on a user's position. The need for such a system and apparatus is particularly acute in the health care field, where currently available beds, mattresses, pillows, or stretchers or examining or surgical tables, may cause great discomfort to a patient. A system that facilitates real-time optimization of the contour of the mattress and a pillow based on a user's position could greatly enhance the safety of patients in neonatal and other critical care settings.

SUMMARY OF THE INVENTION

The invention provides an adjustable mattress and pillow system comprising a sensing mat, a mattress and a pillow which adapts to an optimum contour by pre-selected inflation or deflation of pillow and mattress compartment or compartments based on a user's position to provide an optimum support of a user's body, head, and neck. The sensing mat is put on top of the mattress at a position below the pillow where the upper part of the user's body rests on. The sensing mat, for example, an electrically conductive sensing mat having a mat top outer face for receiving and supporting a user's body and a mat bottom outer face in substantial contact with the mattress top face. In one embodiment, the sensing mat is an electrically conductive sensing mat comprising an electrically conductive membrane comprised of an elastomeric material which exhibits a decreasing electrical resistance when compressed. This membrane may be applied to the mat top face or sandwiched between and in electrical contact with the mat top inner face and mat bottom inner face.

The sensing mat is able to differentiate pressures or applied weight per unit area of a user's upper body in different poses. When a user lays flat (face facing upwards), the pressure load on the mat is less than the pressure load on the mat created when the user reclines sideways, also the width of the loaded area of sensing mat when the user lays in a flat position is wider than the loaded area of the sensing mat with the user in sideways position.

This continuous sensing aspect of the electrically conductive sensing mat embodiment of the invention ensures the greatest degree of controlled optimization of the contour of the mattress and a pillow based on a user's position.

Electrically-conductive elastomers useful in the sensing mat include, but are not limited to, elastomeric polymers containing phosphazene groups, e.g., polymer compositions comprising a polynorbonene backbone and pendant cyclotriphosphazene groups. The electrically conductive membrane could also comprise, for example, materials such as Kevlar® impregnated with electrically conductive metals.

The sensing mat can utilize any number of sensing elements to determine, or differentiate between, the poses or positions of the body of an individual during use of the system of the instant invention. For example, the mat can utilize an infrared sensor, an ultrasonic detector, a digital image scanner, an electrically conductive elastomeric membrane or an electrically conductive silicon rubber. In other embodiments, the mat registers change in user position through capacitors, magnets, thermistors, or pressure transducers.

In still another embodiment, the mat comprises an induction system combined with a piece of metal foil situated under the user being supported. Displacement of the metal foil modifies the self-induction coefficient of the induction coil, shifting the resonant frequency of the LC circuit away from the tuning frequency of an oscillator, thereby damping the signal delivered to an amplifier by the oscillator, so as to ensure that the signal is correctly processed and appropriately monitored.

Thus, the mat in one embodiment can comprise a capacitive array which is interconnected with a pumping/control unit under microprocessor control. The pumping/control unit under microprocessor control supplies to the capacitive array a suitable oscillator derived driver current and concurrently senses capacitance value changes within the capacitive array induced through dielectric shifts within the array brought about by the proximity or absence thereof of the user's body mass. The pumping/control unit under microprocessor control generally comprises a power supply, a driver/sensor circuit, a comparator/calibration logic circuit, a system interconnection integrity circuit and an alarm generation circuit. It may also optionally contain a nurse call relay circuit for interconnection to a facilities nurse call system. Further details of the pumping/control unit under microprocessor control are provided hereinafter.

In one embodiment, the driver/sensor circuit of the pumping/control unit under microprocessor control provides and senses a suitable current to the capacitive array located in the mat. The microprocessor control may be controlled by a comparator/calibration logic circuit that continually analyzes and optimizes signals received from and generated by the driver/sensor circuit. In this way, the logic circuit defines capacitive value parameters which it interprets to indicate whether a user is in close proximity to the capacitive array. In such manner, the logic circuit determines the position of a user on a mat.

In an embodiment of the invention useful in hospitals and other health care institutions, and in particular in neonatal or other critical care applications, if the capacitive value change of the mat remains at a level indicative of a user being in an undesirable position on the mat, the logic circuit would, after a suitable pre-programmed time delay, instruct an alarm circuit to activate. This alarm activation may consist solely of audible and/or visible alarms on or within the pumping/control unit or may be directed to a medical facility's nurse call system through an appropriate interface relay circuit contained either within, or remote to, the pumping/control unit.

In addition to the above described functions, in one embodiment, the microprocessor control logic circuit receives continuous data from a pumping/control unit system interconnection integrity circuit about the continuity of connection between the pumping/control unit and the capacitive sensor array and, where appropriate, between the pumping/control unit and a medical facility's nurse call system.

The logic circuit may also, if appropriate, continuously monitor the entire system during utilization for service faults and subsequently generate appropriate alarms.

In still other embodiments of the invention, the system uses a proximity induced non-compressive dielectric shift sensing mechanism, and thus reliably detects the presence and position of a user on the mat, with minimal discomfort to the user and with a greatly extended sensor element service life.

There are one or more inflatable mattress compartments located within the mattress, the compartments being: (1) positioned between the top face and bottom face of the mattress; (2) connected to a fluid reservoir for receiving fluid; and (3) provided with at least one fluid vent under microprocessor control for discharge of fluid. These inflatable compartments can: (1) take any shape; (2) and be arranged in any number of (vertical or horizontal) positions; and be made of any number of materials, depending upon the intended environment of use of the system. For example, antimicrobial or antibacterial preservatives could be coated on the compartments to avoid the risk of contamination if the system is used in a medical environment. Additionally, anti-static coatings may be applied to the compartments to reduce any risk associated with shock. Compartment shape can also be customized to suit the particular needs of a category of user: for example, certain configurations may prove better suited for children, the elderly, or patients suffering from certain illnesses or injuries.

A pillow is positioned on the top face of the mattress and adapts to an optimum contour for support of a user's head and neck. The pillow comprises a top face for supporting a user's head and neck and a bottom face which is substantially in contact with the mat top face.

The pillow has one or more inflatable pillow compartments located within the pillow, the compartments being: (1) positioned between the top face and bottom face of the pillow; (2) connected to a fluid reservoir for receiving fluid; and (3) provided with at least one fluid vent under microprocessor control for discharge of fluid. The pillow compartment is as versatile as the mattress compartment in terms of design and the entire aforementioned mattress compartment configuration and material examples apply equally to the pillow compartment.

The pillow may or may not be affixed to the top face of the mattress.

The mattress and pillow compartments of the instant invention may be surrounded or packed in a cushioning material such as polymeric foam, man made or natural fiber, to provide additional support and comfort to the user.

As mentioned, the system of the instant invention further comprises a pumping/control unit under microprocessor control that is positioned remotely from the mattress and pillow. The pumping/control unit may comprise any one of a number of devices useful for the conveyance of fluid, e.g., a pump or compressor, and is connected to a fluid reservoir and the inflatable mattress compartments and the inflatable pillow compartments for transmitting fluid from the reservoir to one or more of those compartments. "Positioned remotely" as used above is a relative term; in one embodiment of the instant invention discussed hereinafter, the pumping/control unit, fluid reservoir, pressure sensitive mattress, and pillow are all mounted on the same frame.

As indicated previously, the microprocessor control used in the instant invention: (1) is in communication with, e.g., in electrical contact with, the mat for receiving and processing signals, e.g., electrical signals from the mat which vary in relationship to the pressure exerted on the mat's electrically conductive membrane as the position of the user shifts; (2) processes those signals pursuant to preprogrammed instructions; and (3) transmits an output signal to the pumping/control unit and fluid vents. On the basis of the output signal, fluid is either transmitted from the reservoir by the pumping/control unit to one or more of the inflatable mattress compartments or inflatable pillow compartments, or is discharged from one or more of the inflatable mattress compartments or inflatable pillow compartments by a fluid vent to optimize the contours of the mattress and pillow relative to the user's position on the mattress and pillow.

In another embodiment of the claimed invention, the pumping/control unit is connected to a fluid reservoir and the inflatable mattress compartments and the inflatable pillow compartments for transmitting fluid from the reservoir to one or more of those compartments and for discharging fluid from one or more of those compartments to the reservoir.

The fluid utilized in the instant invention can be any number of suitable liquids or gases, including water, air, and inert gas mixtures.

These and other features of the instant invention are described in greater detail in the following detailed description.

DETAILED DESCRIPTION OF THE INVENTION

Figure 1:
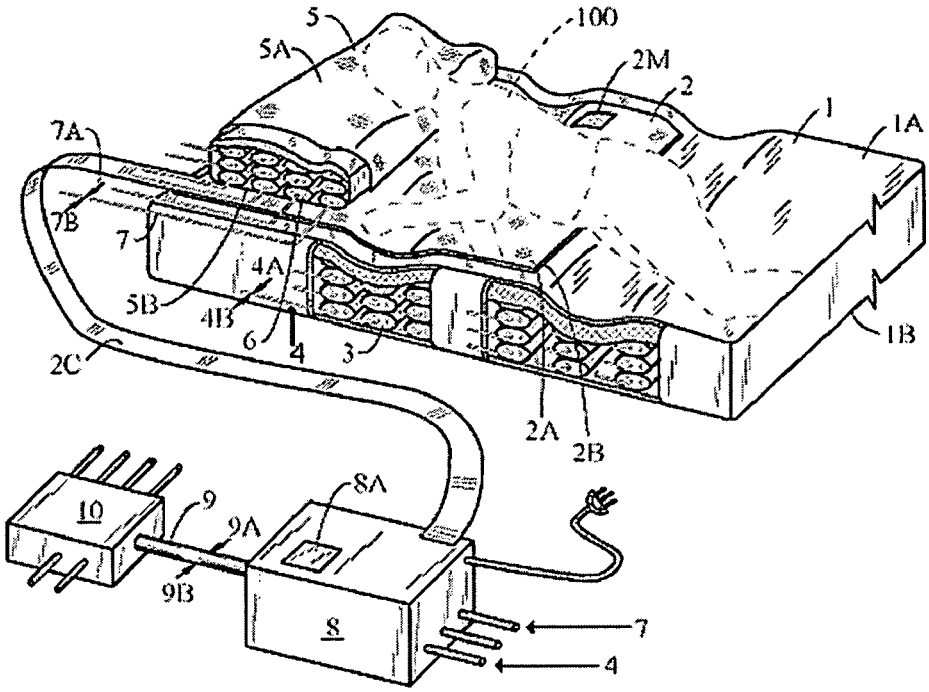
FIG. 1 illustrates a perspective and cross sectional view of a mattress and pillow system and related pumping control unit of the instant invention.

FIG. 1 illustrates an adjustable mattress and pillow system and related pumping control unit of the instant invention comprising a pressure sensitive mattress 1 and a pillow 5 which adapt to an optimum contour for support of the user's 100 body, head, and neck. Pressure sensitive mattress 1 comprises a mattress top face 1A and a mattress bottom face 1B, mattress top face 1A being covered in part by an electrically conductive sensing mat 2 having a mat top outer face 2A for receiving and supporting a user's body and a mat bottom outer face 2B in substantial contact with mattress top face 1A. Electrically conductive sensing mat 2 comprises electrically conductive elastomeric pad 2M, which exhibits a decreasing electrical resistance when compressed and which covers a portion of mattress top face 1A. Conductive sensing mat 2 is just one of the many sensing mat designs that can be employed in connection with the system of the invention.

Figure 2:
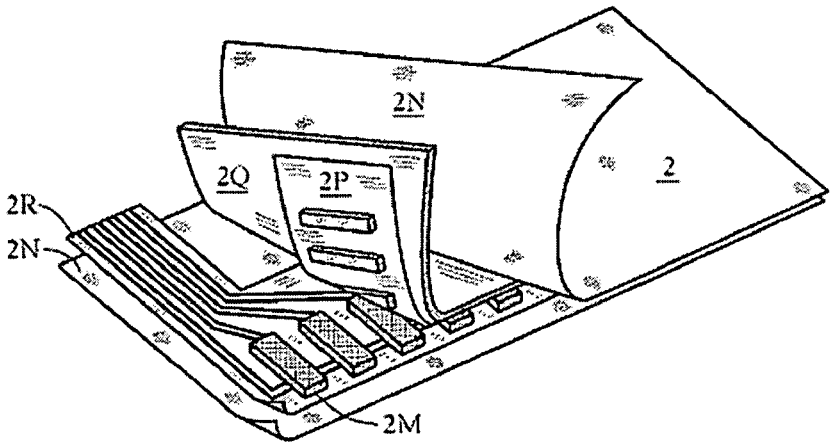
FIG. 2 illustrates a cross-sectional view of a sensitive mat used in the mattress and pillow system of the instant invention.

As shown in FIG. 2, electrically conductive sensing mat 2 can comprise a normal bed sheet fabric layer such as cotton layers 2N which sandwich soft resilient layer such as EVA foam layer 2Q. Soft EVA foam layer 2Q in turn covers flexible conductive layer such as flexible PCB's 2P and 2R. Flexible PCB's 2P and 2R are in electrical contact with conductive elastomeric pad 2M.

Referring again to FIG. 1, one or more inflatable mattress compartments 3 are located within pressure sensitive mattress 1, compartments 3 being: (1) positioned between top face 1A and bottom face 1B of mattress 1; (2) connected through one or more conduits 4 and 9 by pumping/control unit 8 under control of control device 8A to a fluid reservoir 10 for receiving and discharging fluid. Mattress compartments 3 can take any number of shapes. As used herein, "fluid" may be any appropriate liquid or gas useful in controlled inflation and deflation of compartments 3. For example, the fluid used to inflate the compartments can be water, air, or an inert gas, or a combination thereof. Mattress 1 and pillow 5 can be made of any number of suitable materials depending on the durability and sterility needed for any particular application of the invention.

Pillow 5 is positioned on top face 1A of mattress 1 and adapts to an optimum contour for support of a user's 100 head and neck as described hereinafter. Pillow 5 has a top face 5A for supporting a user's head and neck and a bottom face 5B which is substantially in contact with pressure sensitive mattress top face 1A. Pillow 5 has one or more inflatable pillow compartments 6 located within pillow 5, compartments 5 being: (1) positioned between top face 5A and bottom face 5B of pillow 5; and (2) connected to fluid reservoir 10 by conduits 7 and 9 through pumping/control unit 8 under control of control device 8A for receiving and discharging fluid. Pillow 5 may optionally be affixed to mattress top face 1A through, for example, hook and loop fasteners (e.g., Velcro®), snaps, or other well-known means. Pillow compartments 6 can have any number of shapes.

In the illustrated embodiment of FIG. 1, pumping/control unit 8 under control of control device 8A is positioned remotely from mattress 1 and pillow 5. Pumping/control unit 8 and control device 8A need not be part of the same unit or be otherwise attached, provided that they are in communication with one another for the transfer of electrical signals as described hereinafter. Pumping/control unit 8 can be a pump or compressor or any other device suitable for conveyance of a fluid and is connected to a fluid reservoir 10 and inflatable mattress compartments 3 and inflatable pillow compartments 6 for transmitting fluid to compartments 3 and 6 from reservoir 10, and for transmitting fluid from compartments 3 and 6 to reservoir 10. Pumping/control unit 8 could be, e.g., a diaphragm vacuum pump as disclosed in the '858 Patent, or a reversible air pump like that disclosed in U.S. Pat. No. 6,253,401 with various pump control circuitry responsive to control device 8A for purposes of inflating and deflating compartments 3 and 6. The use of a reversible air pump allows the air chambers to be rapidly deflated when desired. Compartments 3 and 6 can be enveloped partially or substantially with a soft, foam-like material to ensure that mattress 1 and pillow 5 provide maximum support.

Figure 3:
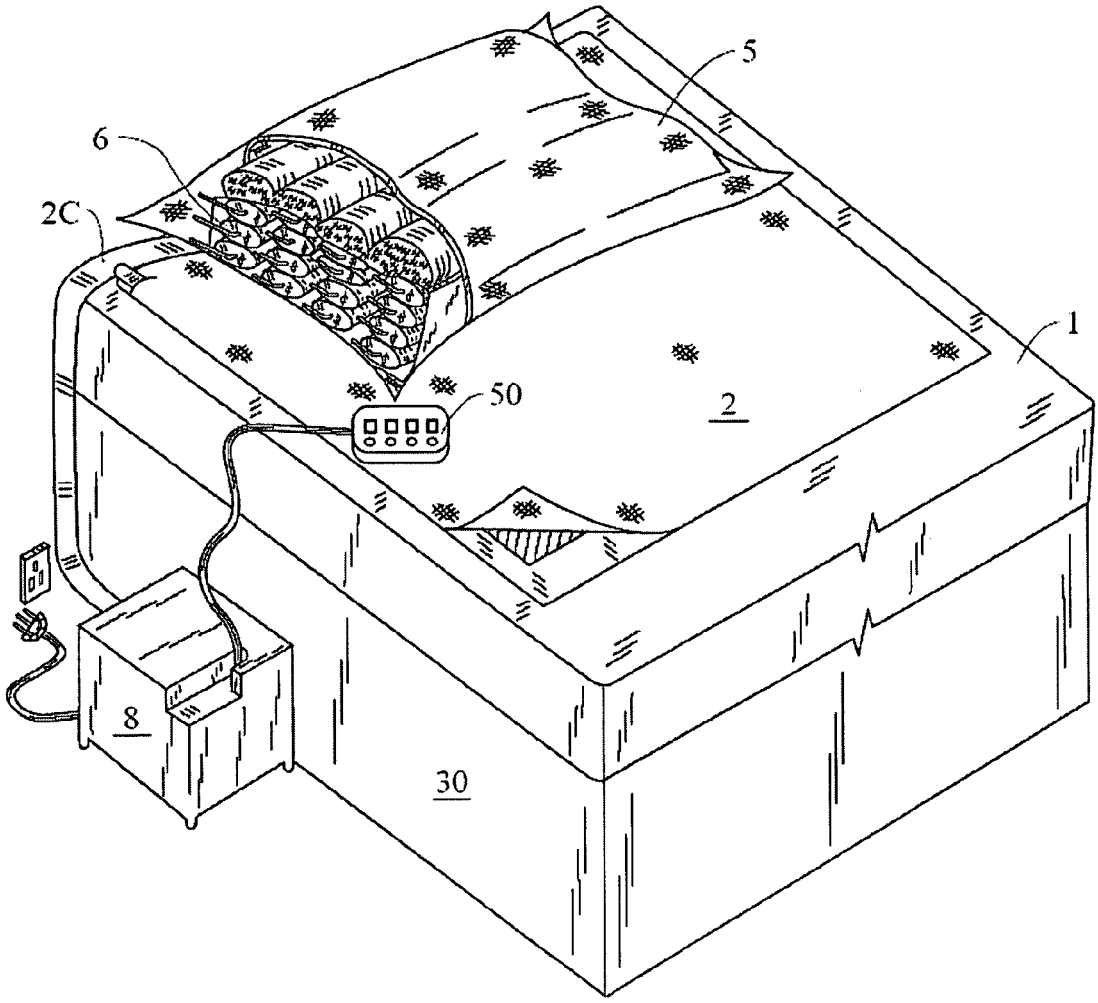
FIG. 3 illustrates a perspective and cross sectional view of a mattress and pillow system and related pumping control unit of the instant invention in which the system is mounted for support on a frame adjacent to the control unit.

As mentioned, "positioned remotely" as used above is a relative term; in another embodiment of the instant invention shown in FIG. 3, pumping/control unit 8 and related control device 8A, fluid reservoir 10, mattress 1 with electrically conductive sensing mat 2, and pillow 5 are optionally connected to frame 30. Further, in some situations, compartments 3 and 6 may discharge fluid to a location other than reservoir 10. For example, where the fluid is an inert gas, under appropriate circumstances the gas may be vented from compartments 3 and 6 to the atmosphere.

Control device 8A comprises a microprocessor which is programmed to control flow of fluid to and from compartments 3 and 6 by regulation of fluid flow through conduit valves 4A, 7A, and 9A and regulation of fluid flow conditions in pumping/control unit 8, in response to electrical signals conveyed from mat 2 through electronics signal wires 2C to control device 8A as described hereinafter. Fluid flow control can be achieved in the system of the instant invention through a variety of standard process control techniques. For example, control device 8A can function as a mass flow controller in which a microprocessor has sensing and signal processing elements in communication with pumping/control unit 8 and valve drives 4B, 7B, and 9B that operate valves 4A, 7A, and 9A to control the mass flow rate of fluid. The microprocessor can be preprogrammed with a set point established by an external input supplied by the user or a third party in order to fix a desired fluid flow rate, and hence mattress 1 and pillow 5 contour, in response to certain signals transmitted from mat 2 through electronics signal wires 2C.

In the embodiment illustrated in FIG. 1, control device 8A operates pumping/control unit 8 and valve drives 4B, 7B, and 9B. To do this, the control device 8A includes a microprocessor which accesses stored fluid flow-mattress/pillow contour calibration information derived for one or more fluids and mattress and pillow materials and design configurations and which covers the operating range of system. From this calibration curve, the fluid flow rate for the fluid to be delivered or released by valves 4A, 7A, and 9A is determined.

The microprocessor used in the instant invention can be a microprocessor having a central processing unit or CPU for a digital processor, which is usually contained in a single semiconductor integrated circuit, or "chip" fabricated by MOS/LSI technology. For example, the microprocessor could be a single-chip 8-bit CPU including a parallel ALU, registers for data and addresses, an instruction register and a control decoder, all interconnected using the von Neumann architecture and employing a bidirectional parallel bus for data, address and instructions. The microprocessor could also be a single-chip "microcomputer" type device which contains a 4-bit parallel ALU and its control circuitry, with on-chip ROM for program storage and on-chip RAM for data storage, constructed in the Harvard architecture. The microprocessor can also be a device employing external memory for program and data storage, or a device with on-chip ROM and RAM for program and data storage. The microprocessor could therefore be a microcomputer. Since the terms "microprocessor" and "microcomputer" are often used interchangeably in the art, however, it should be understood that the use of one of the other of these terms in this description should not be considered as restrictive as to the features of this invention.

The microprocessor can be selected from general-purpose microprocessors and special-purpose micro-computers/microprocessors. General-purpose microprocessors, such as the M68020 manufactured by Motorola, Inc. are designed to be programmable by the user to perform any of a wide range of tasks, and are therefore often used as the central processing unit in equipment such as personal computers. In contrast, special-purpose microcomputers are designed to provide performance improvement for specific predetermined arithmetic and logical functions for which the user intends to use the microcomputer. By knowing the primary function of the microcomputer, the designer can structure the microcomputer in such a manner that the performance of the specific function by the special-purpose microcomputer greatly exceeds the performance of the same function by the general-purpose microprocessor regardless of the program created by the user.

Therefore, a user or third party (e.g., a physician or a nurse) in one embodiment of the instant invention can program a personal computer which functions as part of control device 8A to affect microprocessor-controlled optimization of the contour of the mattress and a pillow based on a user's position.

Control device 8A is in electrical contact with electrically conductive sensing mat 2 through electronics signal wires 2C for receiving and processing electrical signals from mat 2 through electrical contact with flexible PCB 2R shown in FIG. 2. The electrical signals from electrically conductive sensing mat 2 transmitted through electrical contact with flexible PCB 2R (shown in FIG. 2) vary in relationship to the pressure exerted on electrically conductive sensing mat 2 as the position of the user's body shifts. Control device 8A processes those signals using a microprocessor pursuant to preprogrammed instructions and transmits a corresponding output control signal to the pumping/control unit 8 and valve drives 4B, 7B, and 9B. In other embodiments, the output signal could be broadcast, e.g., through known microwave or data broadcast techniques. On the basis of the output signal, as shown by the system illustrated in FIG. 1, fluid is either transmitted from reservoir 10 by pumping/control unit 8 to one or more of inflatable mattress compartments 3 or inflatable pillow compartments 6, or is discharged from one or more of the inflatable mattress compartments 3 or inflatable pillow compartments 6 to optimize the contours of mattress 1 and pillow 5 relative to the user's position on mat 2.

In one illustrative embodiment, electrically conductive sensing mat 2 comprises an induction system combined with a piece of metal foil situated under the user, and wherein displacement of the metal foil modifies a self-induction coefficient of an induction coil, thereby shifting the resonant frequency of an LC circuit away from the tuning frequency of an oscillator and damping the signal delivered to an amplifier by the oscillator to ensure that the signal is correctly processed and appropriately monitored.

In another illustrative embodiment, electrically conductive sensing mat 2 comprises a capacitive array which is interconnected with the pumping/control unit under microprocessor control, and wherein the a pumping/control unit under microprocessor control supplies to the capacitive array a suitable oscillator derived driver current and concurrently senses capacitance value changes within the capacitive array induced through dielectric shifts within the array brought about by the proximity or absence thereof of the user's body mass.

In another illustrative embodiment, the pumping/control unit under microprocessor control comprises a power supply, a driver/sensor circuit, a comparator/calibration logic circuit, a system interconnection integrity circuit and an alarm generation circuit.

In another illustrative embodiment, the pumping/control unit under microprocessor control comprises a nurse call relay circuit for interconnection to a facilities nurse call system.

In still another illustrative embodiment, a system of the invention further comprises a proximity-induced non-compressive dielectric shift sensing mechanism.

Again with reference to FIG. 1, electrically conductive sensing mat 2 is able to differentiate pressures or applied weight per unit area and also the width of the loaded area of sensing mat when the user's body is in different poses. When a user lays flat (face facing upwards), the pressure load on electrically conductive sensing mat 2 is less than the pressure load on electrically conductive sensing mat 2 created when the user reclines sideways. The width of the loaded area of sensing mat when the user lays in a flat position is wider than the loaded area of the sensing mat with the user in sideways position. So by comparing the electrical properties and width of loaded area, this sensing aspect ensures the greatest degree of controlled optimization of the contour of the mattress and a pillow based on a user's position.

Referring to FIG. 3, mattress 1, pillow 5, and electrically conductive sensing mat 2 are positioned atop frame 30 and are in electrical contact with pumping/control unit 8 through electronics signal wires 2C for optimization of the contours of mattress 1 and pillow 5 relative to the user's position on mattress 1 and pillow 5 as described previously. Controller 50 is in electrical contact with pumping/control unit 8 for adjustment of the contours of mattress 1 and pillow 5 as desired. This arrangement of the system of the instant invention ensures that the contours of mattress 1 and pillow 5 can be configured to the exact setting desired by either a user or, say, a physician or nurse attending to such user.

The aforementioned examples of embodiments of the instant invention are illustrative only and in no way limit the full scope of the invention as claimed.

What is claimed is:

1. An adjustable mattress and pillow system comprising:

(a) a mattress which adapts, based on a user's pose on the mattress and in response to variation of the pose, to an optimum contour for support of the user's body, the mattress comprising a mattress top face and a mattress bottom face, the mattress top face being covered in part by an electrically conductive sensing mat having a mat top outer face for receiving and supporting the user's body and a mat bottom outer face in substantial contact with the mattress top face, the mat comprising an electrically conductive elastomeric membrane which exhibits a decreasing electrical resistance when compressed and which covers in part the mat top outer face;

(b) one or more inflatable mattress compartments located within the mattress, the compartments being positioned between the top face and the bottom face of the mattress and connected to a fluid reservoir for receiving and discharging a fluid;

(c) a pillow which is positioned on the top face of the mattress and which adapts to an optimum contour for support of the user's head and neck in response to variation of the user's pose on the mattress, the pillow comprising a top face for supporting the user's head and neck and a bottom face in contact with the mattress top face;

(d) one or more inflatable pillow compartments located within the pillow, the compartments being positioned between the top face and the bottom face of the pillow and connected to the fluid reservoir for receiving and discharging the fluid to vary a contour of the top face of the pillow in response to variation in the user's pose on the mattress;

(e) a pumping/control unit under microprocessor control and positioned remotely from the mattress and the pillow, the microprocessor control being in electrical contact with the mat for receiving and processing electrical signals from the mat, the pumping/control unit being connected to the fluid reservoir and the inflatable mattress compartments and the inflatable pillow compartments for transmitting the fluid from the reservoir to one or more of the compartments and for discharging the fluid from one or more of the compartments to the reservoir, wherein when the user reclines upon the mattress and the pillow, the microprocessor control:

(1) receives electrical input signals from the electrically conductive sensing mat which vary in relationship to the width of an area of the mat compressed by the user and the pressure exerted on the electrically conductive sensing mat as the pose of the user shifts; (2) processes the input signals pursuant to preprogrammed instructions; and (3) transmits an output signal to the pumping/control unit, and wherein depending upon the output signal, fluid is either transmitted from the reservoir by the pumping/control unit to one or more of the inflatable mattress compartments or the inflatable pillow compartments, or is discharged from one or more of the inflatable mattress compartments or the inflatable pillow compartments by the pumping/control unit to the reservoir to optimize the contours of the mattress and the pillow relative to the pose of the user on the mattress and in response to variation of the pose.

2. The system of claim 1, wherein the pumping/control unit is connected to the fluid reservoir and the inflatable mattress compartments and the inflatable pillow compartments by a plurality of conduits and the transmission of the fluid from the reservoir to the compartments, and the discharge of the fluid from the compartments to the reservoir, is regulated by transmission of the output signal to both the pumping/control unit and conduit valves which open and close in response to the output signal.

3. The system of claim 2, wherein the conduits are flexible pipes or hoses, and wherein the mat comprises electrically conductive elastomers sandwiched in between the mat top inner face and the mat bottom inner face.

4. The system of claim 3, wherein the pumping/control unit is a pump.

5. The system of claim 1, wherein the electrically conductive sensing mat is affixed to the mattress top face.

6. The system of claim 1, wherein the fluid is a liquid.

7. The system of claim 1, wherein the fluid is a gas.

8. The system of claim 4, wherein the fluid is a liquid.

9. The system of claim 1, wherein the pillow is affixed to the mattress top face.

10. The system of claim 1, wherein the pillow comprises a cushioning material that envelops the inflatable pillow compartments.

11. The system of claim 1, wherein the mattress comprises a cushioning material that envelops the inflatable mattress compartments.

12. An adjustable mattress and pillow system comprising:

(a) a mattress which adapts, based on a user's pose on the mattress and in response to variation of the pose, to an optimum contour for support of the user's body, the mattress comprising a mattress top face and a mattress bottom face, the mattress top face being substantially covered by an electrically conductive sensing mat having a mat top outer face for receiving and supporting the user's body and a mat bottom outer face in substantial contact with the mattress top face, the electrically conductive sensing mat comprising an electrically conductive elastomeric membrane which exhibits a decreasing electrical resistance when compressed and which substantially covers the mat top outer face;

(b) one or more inflatable mattress compartments located within the mattress, the compartments being (1) positioned between the top face and the bottom face of the mattress (2) connected to a fluid reservoir for receiving fluid, and (3) provided with at least one fluid vent under microprocessor control for discharge of the fluid;

(c) a pillow which is positioned on the top face of the mattress and which adapts to an optimum contour for support of the user's head and neck in response to variation of the user's pose on the mattress, the pillow comprising a top face for supporting the user's head and neck and a bottom face which is substantially in contact with the mat top face;

(d) one or more inflatable pillow compartments located within the pillow to vary a contour of the top face of the pillow in response to variation of the user's pose on the mattress, the compartments being (1) positioned between the top face and the bottom face of the pillow, (2) connected to a fluid reservoir for receiving fluid, and (3) provided with at least one fluid vent under microprocessor control for discharge of the fluid;

(e) a pumping/control unit under microprocessor control and positioned remotely from the mattress and the pillow, the pumping/control unit being connected to the fluid reservoir and the inflatable mattress compartments and the inflatable pillow compartments for transmitting the fluid from the reservoir to one or more of the compartments, wherein the microprocessor control (1) is in electrical contact with the electrically conductive sensing mat for receiving and processing electrical signals from the mat which vary in relationship to the width of an area of the mat compressed by the user and the pressure exerted on the mat as the pose of the user shifts, (2) processes the signals pursuant to preprogrammed instructions, and (3) transmits an output signal to the pumping/control unit and the fluid vents, and wherein, on the basis of the output signal, the fluid is either transmitted from the reservoir by the pumping/control unit to one or more of the inflatable mattress compartments or one or more of the inflatable pillow compartments, or is discharged from one or more of the inflatable mattress compartments or one or more of the inflatable pillow compartments by one or more of the fluid vents to optimize the contours of the mattress and the pillow relative to the user's pose on the mattress and the pillow and in response to variation of the user's pose on the mattress.

13. The system of claim 12, wherein the pumping/control unit is connected to the fluid reservoir and the inflatable mattress compartments and the inflatable pillow compartments by a plurality of intake conduits, and the transmission of fluid from the reservoir to the compartments and the discharge of fluid from the compartments through the vents, is regulated by transmission of the output signal to both the pumping/control unit and intake conduit valves and fluid vent valves which open and close in response to the output signal.

14. The system of claim 13, wherein the intake conduits and the fluid vents are flexible pipes or hoses and wherein the electrically conductive sensing mat comprises electrically conductive elastomers sandwiched in between the electrically conductive sensing mat top inner face and the electrically conductive sensing mat bottom inner face.

15. The system of claim 14, wherein the pumping/control unit is a pump.

16. The system of claim 12, wherein the electrically conductive sensing mat is affixed to the mattress top face.

17. The system of claim 12, wherein the fluid is a liquid.

18. The system of claim 12, wherein the fluid is a gas.

19. The system of claim 14, wherein the fluid is a liquid or a gas.

20. The system of claim 12, wherein the pillow is affixed to the mattress top face.

21. The system of claim 12, wherein the pillow comprises a cushioning material that envelops the inflatable pillow compartments.

22. The system of claim 1, wherein the mattress comprises a cushioning material that envelops the inflatable mattress compartments.

23. An apparatus for supporting a subject in variable, substantially prone poses, comprising the mattress and pillow system of claim 1 or claim 12 supported by a frame, wherein the fluid reservoir, the pumping/control units, and the microprocessor control are also supported by the frame.

24. The apparatus of claim 23, wherein the apparatus is a bed, a stretcher, an examining table, or an operating table.

25. The system of claim 1 or claim 12, wherein the pumping/control unit is under the control of a control device that incorporates the microprocessor and functions as a mass flow controller in which the microprocessor has sensing and signal processing elements in communication with valve drives that operate valves to control the mass flow rate of the fluid to and from the mattress and the pillow compartments.

26. The system of claim 1 or claim 12, wherein the microprocessor is preprogrammed with a set point established by an external input supplied by the user or a third party in order to fix a desired fluid flow rate, and hence the contour of the mattress and the pillow contour, in response to certain signals transmitted from the mat.

27. A method of supporting a body element comprising:

(a) providing an adjustable mattress and pillow system wherein a mattress adapts, based on a user's pose on the mattress and in response to variation of the user's pose, to an optimum contour for support of the user's body, the mattress comprising a mattress top face and a mattress bottom face, the mattress top face being covered in part by an electrically conductive sensing mat having a mat top outer face for receiving and supporting the user's body and a mat bottom outer face in substantial contact with the mattress top face, the electrically conductive sensing mat comprising an electrically conductive elastomeric membrane which exhibits a decreasing electrical resistance when compressed and which substantially covers the mat top outer face;

(b) providing one or more inflatable mattress compartments located within the mattress, wherein the compartments are (1) positioned between the top face and the bottom face of the mattress (2) connected to a fluid reservoir for receiving fluid, and (3) provided with at least one fluid vent under microprocessor control for discharge of the fluid;

(c) providing a pillow which is positioned on the top face of the mattress and which adapts to an optimum contour for support of the user's head and neck in response to variation of the user's pose on the mattress, the pillow comprising a top face for supporting the user's head and neck and a bottom face which is substantially in contact with the mat top face;

(d) providing one or more inflatable pillow compartments located within the pillow for varying a contour of the top face of the pillow in response to variation of the user's pose on the mattress, wherein the compartments are (1) positioned between the top face and the bottom face of the pillow, (2) connected to a fluid reservoir for receiving a fluid, and (3) provided with at least one fluid vent under microprocessor control for discharge of the fluid;

(e) providing a pumping/control unit under microprocessor control and positioned remotely from the mattress and the pillow, wherein the pumping/control unit is connected to the fluid reservoir and the inflatable mattress compartments and the inflatable pillow compartments for transmitting a fluid from the reservoir to one or more of the compartments, and wherein when the user is positioned upon the mattress top face and the pillow, the microprocessor control (1) is in electrical contact with the mat for receiving and processing electrical signals from the mat which vary in relationship to the width of the area of the mat compressed by the user and the pressure exerted on the mat as the pose of the user shifts, (2) processes the signals pursuant to preprogrammed instructions and, (3) transmits an output signal to the pumping/control unit and the fluid vents, and wherein, on the basis of the output signal, a fluid is either transmitted from the reservoir by the pumping/control unit to one or more of the inflatable mattress compartments or the inflatable pillow compartments, or is discharged from one or more of the inflatable mattress compartments or the inflatable pillow compartments by the fluid to optimize the contours of the mattress and the pillow relative to the user's pose on the mattress and the pillow and in response to variation of the user's pose on the mattress.

28. The method of claim 27, wherein the pumping/control unit is connected to the fluid reservoir and the inflatable mattress compartments and the inflatable pillow compartments by a plurality of intake conduits, and the transmission of the fluid from the reservoir to the compartments and the discharge of the fluid from the compartments through the vents, is regulated by the transmission of the output signal to both the pumping/control unit and the intake conduit valves and the fluid vent valves, which open and close in response to the output signal.

29. The method of claim 28, wherein the intake conduits and the fluid vents are flexible pipes or hoses, and wherein the mat comprises electrically conductive elastomers sandwiched in between the mat top inner face and the mat bottom inner face.

30. The method of claim 27, wherein the pumping/control unit is a pump.

31. The method of claim 27, wherein the electrically conductive sensing mat is affixed to the mattress top face.

32. The method of claim 27, wherein the fluid is a liquid or a gas.

33. The method of claim 27, wherein the pillow is affixed to the mattress top face.

34. The method of claim 27, wherein the pillow comprises a cushioning material that envelops the inflatable pillow compartments.

35. The method of claim 27, wherein the mattress comprises a cushioning material that envelops the inflatable mattress compartments.

36. The method of claim 27, wherein the pumping/control unit is under the control of a control device that incorporates the microprocessor and functions as a mass flow controller in which the microprocessor has sensing and signal processing elements in communication with valve drives that operate valves to control the mass flow rate of fluid to and from the mattress and pillow compartments.

37. The method of claim 27, wherein the microprocessor is preprogrammed with a set point established by an external input supplied by the user or a third party in order to fix a desired fluid flow rate, and hence mattress and pillow contour, in response to certain signals transmitted from mat.

38. An adjustable mattress and pillow system comprising:

(a) a mattress which adapts, based on a user's pose on the mattress and in response to variation of the user's pose on the mattress, to an optimum contour for support of the user's body, the mattress comprising a mattress top face and a mattress bottom face, the mattress top face being covered in part by a sensing mat having a mat top outer face for receiving and supporting the user's body and a mat bottom outer face in substantial contact with the mattress top face, the mat comprising an elastomeric sensing membrane which covers in part the mat top outer face and which, when compressed, transmits a sensing signal;

(b) one or more inflatable mattress compartments located within the mattress, wherein the compartments are positioned between the top face and the bottom face of the mattress and are connected to a fluid reservoir for receiving or discharging fluid;

(c) a pillow which is positioned on the top face of the mattress and which adapts to an optimum contour for support of the user's head and neck in response to variation of the user's pose on the mattress, the pillow comprising a top face for supporting the user's head and neck and a bottom face which is substantially in contact with the mattress top face;

(d) one or more inflatable pillow compartments located within the pillow to vary a contour of the top face of the pillow in response to variation of the user's pose on the mattress, wherein the pillow compartments are positioned between the top face and the bottom face of the pillow and are connected to a fluid reservoir for receiving or discharging a fluid;

(e) a pumping/control unit which is under microprocessor control and which is positioned remotely from the mattress and the pillow, wherein the microprocessor control is in electrical contact with the mat for receiving and processing sensing signals from the mat, wherein the pumping/control unit is connected to a fluid reservoir and the inflatable mattress compartments and the inflatable pillow compartments for transmitting a fluid from the reservoir to one or more of the inflatable mattress compartment and the inflatable pillow compartments and for discharging fluid from one or more of the inflatable mattress compartment and the inflatable pillow compartments to the reservoir, and wherein, when the user reclines upon the mattress and the pillow, the microprocessor control (1) receives and processes input sensing signals from the sensing mat into electrical signals which vary in relationship to the width of the area of the mat compressed by the user and the pressure exerted on the sensing mat as the pose of the user shifts, (2) processes the electrical signals pursuant to preprogrammed instructions and, (3) and transmits an output signal to the pumping/control unit, and wherein on the basis of the output signal, the fluid is either transmitted from the reservoir by the pumping/control unit to one or more of the inflatable mattress compartments or inflatable pillow compartments, or is discharged from one or more of the inflatable mattress compartments or inflatable pillow compartments by the pumping/control unit to the reservoir to optimize the contours of the mattress and the pillow relative to the user's pose on the mattress and the pillow and in response to variation of the pose of the user on the mattress.

39. The system of claim 38, wherein the sensing mat utilizes either an infrared sensor, an ultrasonic detector, a digital image scanner, an electrically conductive elastomeric membrane, or electrically conductive silicon rubber to transmit input sensing signals from the sensing mat to the microprocessor control.

40. The system of claim 38, wherein the mat comprises an induction system combined with a piece of metal foil situated under the user, and wherein displacement of the metal foil modifies a self-induction coefficient of an induction coil, thereby shifting the resonant frequency of an LC circuit away from the tuning frequency of an oscillator and damping the signal delivered to an amplifier by the oscillator to ensure that the signal is correctly processed and appropriately monitored.

41. The system of claim 38, wherein the mat comprises a capacitive array which is interconnected with the pumping/control unit which is under microprocessor control, and wherein the pumping/control unit which is under microprocessor control supplies to the capacitive array a suitable oscillator derived driver current and concurrently senses capacitance value changes within the capacitive array induced through dielectric shifts within the array brought about by the proximity or absence thereof of the user's body mass.

42. The system of claim 38, wherein the pumping/control unit which is under microprocessor control comprises a power supply, a driver/sensor circuit, a comparator/calibration logic circuit, a system interconnection integrity circuit and an alarm generation circuit.

43. The system of claim 42, wherein the pumping/control unit which is under microprocessor control comprises a nurse call relay circuit for interconnection to a facilities nurse call system.

44. The system of claim 42, wherein the system further comprises a proximity induced non-compressive dielectric shift sensing mechanism.

* * * * *